US008515743B2

(12) United States Patent
Zhang et al.

(10) Patent No.: US 8,515,743 B2
(45) Date of Patent: Aug. 20, 2013

(54) METHOD AND APPARATUS FOR SEARCHING FIXED CODEBOOK

(75) Inventors: Dejun Zhang, Shenzhen (CN); Lixiong Li, Shenzhen (CN)

(73) Assignee: Huawei Technologies Co., Ltd, Shenzhen (CN)

( * ) Notice: Subject to any disclaimer, the term of this patent is extended or adjusted under 35 U.S.C. 154(b) by 651 days.

(21) Appl. No.: 12/477,989

(22) Filed: Jun. 4, 2009

(65) Prior Publication Data

US 2009/0240493 A1 Sep. 24, 2009

Related U.S. Application Data

(63) Continuation of application No. PCT/CN2008/071485, filed on Jun. 30, 2008.

(30) Foreign Application Priority Data

Jul. 11, 2007 (CN) ..... 2007 1 0130517

(51) Int. Cl.
*G10L 19/04* (2013.01)
*G10L 19/12* (2013.01)

(52) U.S. Cl.
USPC ..... 704/219; 704/222; 704/E19.023; 704/E19.017

(58) Field of Classification Search
None
See application file for complete search history.

(56) References Cited

U.S. PATENT DOCUMENTS 5,187,745 A 2/1993 Yip et al.
5,202,953 A 4/1993 Taguchi
5,444,816 A 8/1995 Adoul et al.
5,699,482 A 12/1997 Adoul et al.
5,701,392 A 12/1997 Adoul et al.
5,754,976 A 5/1998 Adoul et al.
5,822,724 A 10/1998 Nahumi
6,480,822 B2 11/2002 Thyssen (Continued)

FOREIGN PATENT DOCUMENTS

CN 1181151 A 5/1998
CN 1395724 A 2/2003

(Continued)

OTHER PUBLICATIONS

Summons to attend oral proceedings, mailed Dec. 20, 2010, issued in related European Application No. 08773063.6, Huawei Technologies Co. Ltd.

(Continued)

*Primary Examiner* — Angela A Armstrong
(74) *Attorney, Agent, or Firm* — Huawei Technologies Co., Ltd

(57) ABSTRACT

A method and apparatus for searching fixed codebook are provided. The method includes: obtaining a basic codebook which comprises position information of N pulses on M tracks, wherein N and M are positive integers; choosing n pulses as search pulses, wherein the n pulses are parts of the N pulses and n is a positive integer smaller than N; and replacing position information of the n search pulses respectively with other position information on the tracks to obtain a searched codebook; executing the search process for K times, wherein K is a positive integer larger than or equal to 2, at least two or more search pulses are chosen in one of the K search processes, and the chosen search pulses vary in each of the K search processes; and obtaining an optimal codebook from the basic codebook and the searched codebook according to a preset criterion.

19 Claims, 5 Drawing Sheets

(56) References Cited

U.S. PATENT DOCUMENTS

| | | | | |
|---|---|---|---|---|
| 7,206,739 | B2 | 4/2007 | Lee | |
| 2003/0033136 | A1* | 2/2003 | Lee | 704/2 |
| 2003/0046067 | A1 | 3/2003 | Gradl | |
| 2004/0093204 | A1 | 5/2004 | Byun et al. | |
| 2004/0093368 | A1 | 5/2004 | Lee et al. | |
| 2004/0181400 | A1 | 9/2004 | Kannan et al. | |
| 2004/0193410 | A1* | 9/2004 | Lee et al. | 704/219 |
| 2007/0043560 | A1 | 2/2007 | Lee | |
| 2009/0096471 | A1 | 4/2009 | Eden | |
| 2011/0046303 | A1 | 2/2011 | Harings et al. | |

FOREIGN PATENT DOCUMENTS

| | | | |
|---|---|---|---|
| CN | 1547193 | A | 11/2004 |
| CN | 1766988 | A | 5/2006 |
| CN | 101118748 | A | 2/2008 |
| JP | 10-513571 | A | 12/1998 |
| JP | 11-501131 | A | 1/1999 |
| JP | 2003308100 | A | 10/2003 |
| JP | 2011501131 | A | 1/2011 |
| JP | 2011513571 | A | 4/2011 |
| KR | 2002-0090882 | | 5/2002 |
| KR | 20020090882 | A | 12/2002 |
| WO | WO 2007/027005 | A1 | 3/2007 |
| WO | WO2007027005 | A1 | 3/2007 |

OTHER PUBLICATIONS

Korean Office Action dated (mailed) Dec. 14, 2010, issued in related Korean Application No. 10-2009-7012233 Huawei Technologies Co. Ltd.

International Search Report from P.R. China in International Application No. PCT/CN2008/071485 mailed Oct. 16, 2008.

European Patent Office Communication pursuant to Article 94(3) EPC, European search opinion for Application No. 08773063.6-1224, mailed Apr. 26, 2010, Huawei Technologies C., Ltd 6 pgs.

Eung-Don Lee, et al., "Efficient Fixed Codebook Search Method for ACELP Speech Codecs", Nov. 9, 2006, Advances in Hybrid Information Technology; (Lecture Notes in Computer Science), Springer Berlin Heidelberg, Berlin, pp. 178-187.

PCT International Preliminary Report on Patentability which includes an English Translation of Written Opinion of the International Searching Authority in PCT Application No. PCT/CN2006/002519, dated Feb. 1, 2007, attached as a reference, 4 pgs.

European Communication pursuant to Rule 62 EPC, the supplementary European Search Report (Art. 153 (7) EPC) and the European search opinion for Application No. 08 77 3063, dated Dec. 10, 2009, 8 pgs.

JPO Decision of Refusal mailed Jul. 3, 2012, issued in related Japanese Application No. 2009-548568, Huawei Technologies Co., Ltd. (9 pages).

European Patent Office Decision to Refuse a European Patent Application for Application No. 08773063.6-1224, mailed Sep. 3, 2011, Huawei Technologies Co., Ltd.

Result of Consultation for European Patent Application No. 08773063.6-1224, dated Jun. 22, 2011, Huawei Technologies Co., Ltd.

Brief Communication for European Patent Application No. 08773063.6-1224, dated Jun. 10, 2011, Huawei Technologies Co., Ltd.

Korean Office Action mailed Oct. 21, 2011, for Korean Application 10-2009-7012233, Huawei Technologies Co., Ltd.

A-N suen et al. : "Dynamic partial search scheme for stochastic codebook of FS1016 CELP coder", Feb. 1995, total 7 pages.

Notice of Allowance issued in corresponding to JP application No. 2009-548567,dated Dec. 11, 2012, and its English translation thereof, total 4 pages.

Japanese Office Action dated (mailed) Dec. 13, 2011, issued in related Japanese Application No. 2009-548568, Huawei Technology Co. Ltd.

* cited by examiner

METHOD AND APPARATUS FOR SEARCHING FIXED CODEBOOK

This application is a continuation of International Patent Application No. PCT/CN2008/071485, filed Jun. 30, 2008, and entitled "Method and Apparatus for Searching fixed Codebook," which claims the benefit of priority to Chinese Patent Application No. 200710130517.2, filed with the Chinese Patent Office on Jul. 11, 2007, and entitled "Method and Apparatus for Searching Fixed Codebook", the entireties of both of which are hereby incorporated by reference in their entireties.

FIELD OF THE DISCLOSURE

The present disclosure relates to vector coding, and in particular, to a method and apparatus for searching fixed codebook.

BACKGROUND OF THE DISCLOSURE

A common vector coding technique quantizes and encodes the residual signal after adaptive filtering according to one type of fixed codebook, e.g., algebraic codebook. The algebraic codebook is concerned about the pulse position of a target signal and considers the pulse amplitude as 1 by default. Therefore, it is only necessary to quantize the pulse symbol and pulse position. Surely, multiple pulses can be superimposed in one position to represent different amplitudes. When quantization and coding are performed according to the algebraic codebook, it is an important activity to determine the positions of all pulses of the optimal algebraic codebook corresponding to the target signal. Generally, a full search (i.e., traverse all possible position combinations) for the optimal pulse position is subject to complex computation. It is therefore necessary to find a sub-optimal search algorithm. It is a main goal of search algorithm research and development to minimize the number of searches and reduce the complexity of computation while guaranteeing the quality of a search result.

A Depth-First Tree Search Procedure is described below to explain a sub-optimal searching method adopted in algebraic codebook based pulse position search according to a prior art.

Suppose, for example, the length of a speech subframe is 64 bits. Depending on the bit rate of coding, the number of pulses to search for (hereunder referred to as search pulses) varies. Suppose, for example, the number is N. Without other restrictions, searching for N pulses at 64 positions requires overly-complex computations. Therefore, the method constrains the pulse positions of the algebraic codebook by dividing the 64 positions into M tracks. A typical track planning model is described in Table 1.

TABLE 1

| Track | Positions |
|---|---|
| T0 | 0, 4, 8, 12, 16, 20, 24, 28, 32 36, 40, 44, 48, 52, 56, 60 |
| T1 | 1, 5, 9, 13, 17, 21, 25, 29, 33, 37, 41, 45, 49, 53, 57, 61 |
| T2 | 2, 6, 10, 14, 18, 22, 26, 30, 34, 38, 42, 46, 50, 54, 58, 62 |
| T3 | 3, 7, 11, 15, 19, 23, 27, 31, 35, 39, 43, 47, 51, 55, 59, 63 |

In Table 1, T0-T3 are 4 tracks and positions specify the position numbers included by each track. The 64 positions are divided into 4 tracks and each track contains 16 positions. The pulse positions of the 4 tracks are interlaced with each other to guarantee the combinations of all pulse positions to the greatest extent.

The N search pulses are restrained to the M=4 tracks according to a certain distribution mode. The following description assumes N=4 and 1 pulse is located on each track. The search procedure in other occasions can be deduced from this description.

Suppose, for example, the search pulses on T0-T3 are respectively P0-P3, and each search process searches for two pulses on two adjacent tracks, for example, T0-T1, T1-T2, T2-T3, and T3-T0. The final optimal codebook is obtained by a 4-level search. As shown in FIG. 1, the procedure includes the following blocks:

Block 1: A level-1 search is performed on T0-T1 and T2-T3. First, the positions of P0 and P1 are searched for on T0-T1, where P0 is searched for in 4 of the 16 positions on T0. The 4 positions are determined by extreme values of known reference signals on the track; P1 is searched for in the 16 positions on T1. The optimal positions of P0 and P1 are determined among the 4 position combinations searched for according to a preset criterion. Then the positions of P2 and P3 are searched for on T2-T3, where P2 is searched for in 8 of the 16 positions on T2. The 8 positions are determined by extreme values of known reference signals on the track; P3 is searched for in the 16 positions on T3. Finally, the optimal positions of P2 and P3 are determined. The level-1 search is complete.

Block 2: A level-2 search is performed on T1-T2 and T3-T0. The search process is similar to the level-1 search.

Block 3: Similarly, a level-3 search is performed on T2-T3 and T0-T1, and a level-4 search is performed on T3-T0 and T1-T2.

Block 4: Finally, an optimal result among the four search results is selected as the optimal algebraic codebook.

The total number of searches is $4\times(4\times16+8\times16)=768$.

However, it has been found that, although the foregoing search algorithm obtains good speech quality under various bit rates, the number of searches is large and the computation is complex.

SUMMARY OF THE DISCLOSURE

Accordingly, a method and apparatus for searching fixed codebook are provided so as to obtain good speech quality with low complexity of computation.

A method for searching fixed codebook according to an embodiment of the present disclosure includes: obtaining a basic codebook which comprises position information of N pulses on M tracks, wherein N and M are positive integers; choosing n pulses as search pulses, wherein the n pulses are parts of the N pulses and n is a positive integer smaller than N; replacing position information of the n search pulses respectively with other position information on the tracks to obtain a searched codebook; executing the search process K times, wherein K is a positive integer larger than or equal to 2, at least two or more search pulses are chosen in one of the K search processes, and the chosen search pulses vary in each of the K search processes; and obtaining an optimal codebook from the basic codebook and the searched codebook according to a preset criterion.

An apparatus for searching fixed codebook according to an embodiment of the present disclosure includes: a basic codebook unit adapted to provide a basic codebook which comprises position information of N pulses on M tracks, wherein N and M are positive integers; a search cycling unit adapted to choose search pulses and determine to perform K cyclic searches on the search pulses in a round as follows: choose n pulses as search pulses, wherein the n pulses are part of the N pulses and n is a positive integer smaller than N, and wherein K is a positive integer larger than or equal to 2, at least one of the K searches chooses two or more search pulses, and the chosen search pulses vary with each search; a searching unit adapted to replace positions of the n search pulses respectively with other positions on the tracks according to each choice of the search cycling unit to obtain a searched codebook; and a computing unit adapted to choose an optimal codebook of the current round from the basic codebook and the searched codebook obtained by the searching unit after K cyclic searches according to a preset criterion.

A method for searching fixed codebook according to an embodiment of the present disclosure includes: obtaining a basic codebook which comprises N pulses as a preferred codebook, wherein positions of the N pulses are on M tracks, N and M are positive integers; choosing n search pulses, wherein the n search pulses are parts of the N pulses and n is a positive integer smaller than N; replacing positions of the n search pulses respectively with other positions on their tracks to obtain a searched codebook; selecting the better one from the searched codebook and the current preferred codebook as a new preferred codebook according to a preset criterion; executing the processes of obtaining the search codebook and the preferred codebook for K times and obtaining a preferred codebook as an optimal codebook, wherein K is a positive integer larger than or equal to 2, two or more search pulses chosen at least one of the K times.

In the embodiments of the disclosure, the optimal codebook is obtained by replacing pulse combinations, where at least one search covers multiple pulses. Because the optimal codebook is obtained by means of replacing multiple combinations, the number of searches can be reduced while a global search is achieved; by choosing different combinations of search pulses for each search process, the search pulse choosing mode is improved so that the search process is more efficient and the quality of a search result is improved.

DETAILED DESCRIPTION OF THE EMBODIMENTS

For a better understanding of this disclosure, the following descriptions use an Ethernet ring as an example to describe certain embodiments in detail with reference to accompanying drawings.

Embodiment 1 of the disclosure provides a method for searching a fixed codebook, which chooses an optimal codebook by replacing pulse combinations based on a basic codebook, where at least one search covers multiple pulses. Accordingly, an apparatus for searching fixed codebook is provided in embodiment 1 of the disclosure. The method and apparatus provided by the embodiments of the present disclosure are described in detail hereunder.

Figure 1:
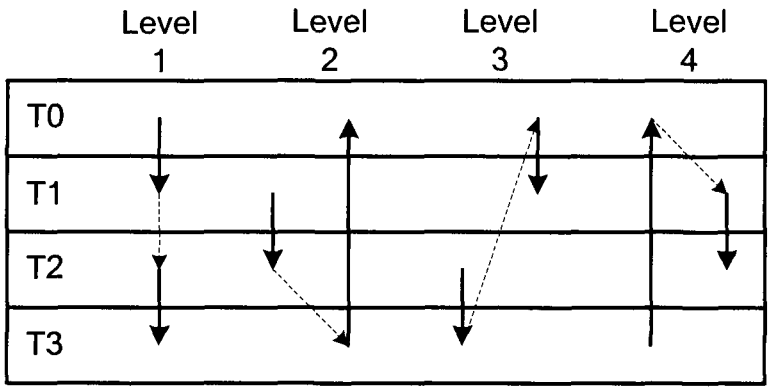
FIG. 1 shows a Depth First Tree Search Procedure in a prior art.
Figure 2:
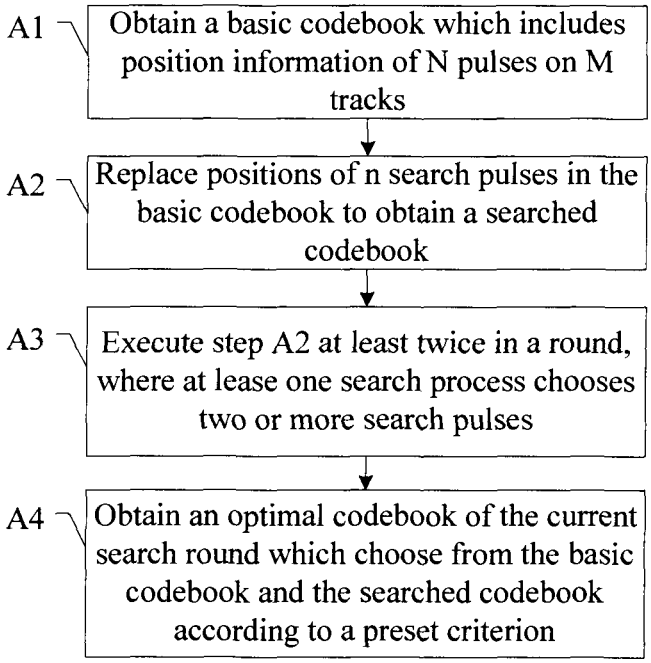
FIG. 2 is a flowchart of a method for searching fixed codebook according to an embodiment of the disclosure.

According to embodiment 1 of the disclosure, a method for searching fixed codebook, as shown in FIG. 2, includes the following blocks:

A1. Obtaining a basic codebook, which includes position information of N pulses on M tracks, where N and M are positive integers.

The basic codebook referred to herein is an initial codebook serving as the search basis in a round of search. Normally, before the search for pulse positions of an algebraic codebook, the quantitative distribution of the search pulses to be searched on the tracks is determined according to bit rate and other information. The pulse search in speech coding based on quantization is taken as an example. That is, 64 positions are divided into M tracks, where M is equal to 4, with T0, T1, T2, and T3, as defined in Table 1. According to different bit rate, the possible quantitative distribution of pulses is: N=4, with 1 pulse searched on each track; N=8, with 2 pulses on each track; or N=5, with 1 pulse searched respectively on T0, T1, and T2, and 2 pulses on T3.

After the quantitative distribution of N pulses on M tracks is determined, the basic codebook is obtained by obtaining the initial position of each pulse on each track. The initial position of a pulse may be determined by any of the following methods without being limited by the present disclosure. For example, 1. Choosing any position on the track where the pulse is located at random as the initial position of the pulse;

2. Determining the positions of pulses on a corresponding track according to several extreme values of known reference signals on each track;

3. Obtaining the initial position (basic codebook) of the pulse in a computation mode.

One optional reference signal is a pulse position maximum-likelihood function (also known as pulse amplitude selection signal). The function can be represented as:

$$b(i) = \sqrt{\frac{E_d}{E_r}} \times r_{LTP}(i) + a \times d(i),\ i = 0, \ldots, 63$$

Where, d(i) stands for dimensional components of the vector signal d determined according to the target signal to quantize, which may generally be represented by a convolution of the target signal and the pre-filtered pulse response of a weighted synthesis filter; $r_{LTP}(i)$ stands for dimensional components of the residual signal r of Long Term Prediction (LTP); $E_d$ is the energy of signal d; $E_r$ is the energy of signal r; a is a proportion factor which controls the dependency of the reference signal d(i) and may vary depending on the bit rate. The values of b(i) in 64 positions are calculated and the position where the largest b(i) is obtained is taken as the initial position of the pulse on the respective tracks of T0-T3.

A2. Choosing n pulses as search pulses, wherein the n pulses are parts of the N pulses and n is a positive integer smaller than N. Choosing n pulses as search pulses is as follows: Choosing n pulses from Ns pulses as search pulses, where the Ns pulses are all or parts of the N pulses, Ns is a positive integer smaller than or equal to N, and n is a positive integer smaller than Ns; fixing the positions of pulses in the basic codebook other than the n search pulses and replacing the positions of the n search pulses respectively with other positions on their track to obtain a searched codebook.

The pulses that can be chosen as the search pulses may be all or part of the Ns pulses. A set of pulses that can be chosen as the search pulses is hereinafter referred to as the Ns set. If any of the N pulses is outside the Ns set, the positions of the any of the N pulses are preferred positions and the search can be stopped.

Various methods can be adopted to choose n pulses from the Ns pulses as the search pulses, without being limited by the present disclosure. For example, the method may be:

1. Choosing the value of n and a combination of search pulses at random. Suppose, for example, the Ns set includes 3 pulses: P0, P1 and P2. Then the possible choices are: n=1 and the search pulse is P1; n=2 and the search pulses are P0 and P2; n=2 and the search pulses are P1 and P2.

2. Determining the value of n, larger than or equal to 2, and choosing a random combination of search pulses.

Suppose, for example, the Ns set includes 4 pulses, P0, P1, P3 and P4 and n=3 is determined. Then the possible choices include: the search pulses are P0, P1 and P2; the search pulses are P0, P2 and P3; the search pulses are P0, P1, and P3; the search pulses are P1, P2 and P3.

After the combination of search pulses is determined, replacing the corresponding positions in the basic codebook with other positions on the track of the search pulses to obtain the searched codebook.

Suppose, for example, the basic codebook includes N=4 pulses, where P0, P1, P2, and P3 are respectively located on M=4 tracks (e.g., T0, T1, T2, and T3), with one pulse located on each track.

If the search pulses chosen by one search process are P2 and P3, the positions of P0 and P1 in the basic codebook are fixed. Replacing the position of P2 with other positions (suppose, for example, there are t2 such positions) on T2 respectively and replace the position of P3 with other positions (suppose, for example, there are t3 such positions) on T3. Then there are altogether $(t2+1)\times(t3+1)-1=t2\times t3+t2+t3$ corresponding searched codebooks.

It should be understood that the positions on the searched track for replacement may be all positions on the track, or only include positions in a set range. For example, a part of positions may be chosen from the searched track according to values of a known reference signal.

A3. Executing K search processes in block A2 as a round. The search pulses chosen by each search process are not all the same. K is a positive integer larger than or equal to 2. At least one search process chooses two or more search pulses.

The number of cyclic executions of block A2 (i.e., K) may be a specific upper limit value. When K search processes are complete, a round of search is considered complete.

In addition, the embodiment of the disclosure may not limit the value of K. This means the value of K is uncertain. An end-of-search condition is used to determine whether a round of search is complete. For example, when the chosen search pulses have traversed the Ns set, the search round is determined complete. Alternatively, the foregoing two methods may be combined so that the end-of-search condition is used to determine whether a search round is complete while the number of searches is not larger than a set K. If the number of searches reaches the upper limit K, the search round is considered complete even if the end-of-search condition is not met. The specific rule depends on the actual needs and is not limited by the embodiment of the disclosure.

To enable the search result to reflect the correlations between pulses, the embodiment of the disclosure requires that at least one of the K searches covers two or more pulses, where the chosen search pulses may be distributed on one or different tracks.

A4. Obtaining the optimal codebook in the current search round which chose from the basic codebook and the searched codebook according to a preset criterion.

The process of evaluating the searched codebook and the basic codebook may be executed simultaneously with the search process in block A2. For example, a preferred codebook may be set with the initial value as the basic codebook; then after a searched codebook is obtained, the searched codebook is compared with the current preferred codebook, and if the searched codebook is better that the current preferred codebook, the searched codebook takes the place of the current preferred codebook. The preferred codebook finally obtained when all the K searches are complete is the optimal codebook of the search round. It should be noted that the basis of each search is still the basic codebook but the object of comparison is the preferred codebook.

In an alternate embodiment, the results of K searches may be compared at one time. For example, the preferred codebook obtained by each search is stored and K preferred codebooks are compared at one time to choose an optimal codebook.

The criterion for comparing and evaluating the searched codebook and the basic codebook may depend on the actual needs without being limited by the embodiment of the disclosure. For example, a cost function (Qk) commonly used to measure the quality of an algebraic codebook may be adopted as the comparison criterion. Usually, in such an embodiment, the larger the value of Qk, the better the codebook. Therefore, the codebook of a larger Qk may be chosen as the preferred codebook.

In this embodiment of the disclosure, the optimal codebook is obtained by replacing pulse combinations, where at least one search covers multiple pulses. Because the optimal codebook is chosen from replacements of different combinations, the method can reduce the number of searches to the greatest possible extent while guaranteeing a global search. In addition, because at least one search covers multiple pulses, the impact of correlations between pulses on the search result can be considered so as to further assure the quality of the search result.

Figure 3:
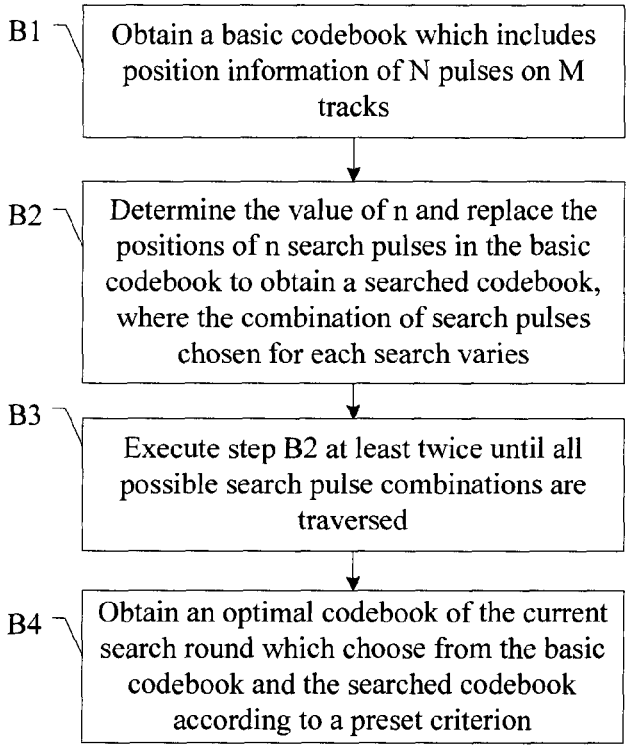
FIG. 3 is a flowchart of a method for searching fixed codebook according to an embodiment of the disclosure.

In embodiment 2 of the disclosure, a method for searching fixed codebook is provided with a specific procedure for choosing search pulses on the basis of the embodiment 1. As shown in FIG. 3, the procedure includes the following blocks:

B1. Obtaining a basic codebook, which includes position information of N pulses on M tracks, where N and M are positive integers.

This block may be performed with reference to block A1 in the foregoing embodiment.

B2. Choosing n=n0 search pulses from the Ns pulses, where Ns means the same as in the embodiment 1 and n0 is larger than or equal to 2 and remains unchanged in the current round of search; the chosen n0 search pulses are one of all $C_{NS}^{n}$ possible combinations and are not chosen repetitively.

Suppose, for example, the Ns set includes N=4 pulses, P0, P1, P2 and P3, respectively located on M=4 tracks, T0, T1, T2 and T3, with one pulse located on each track. Set n=n0=2 and there are altogether $C_{Ns}^{n}=6$ possible combinations having the chosen 2 search pulses from the Ns set, including: P0, P1; P0, P2; P0, P3; P1, P2; P1, P3; P2, P3. The choice may be random or sequential from the 6 combinations. In order that no choice is repeated, the combinations may be chosen according to the law of change, or all combinations are stored or numbered, and the combinations (or numbers) already chosen may be deleted.

B3. Taking K search processes in block A2 as a round. The search pulses chosen by each search process are not all the same. K meets the condition $2 \leqq K \leqq C_{Ns}^{n}$. At least one search process chooses two or more search pulses.

Because n takes a fixed value, and each chosen combination of search pulses is not repeated, all possible combinations in the Ns set are traversed after at most $C_{Ns}^{n}$ searches. Alternatively, the upper limit of K may be set to smaller than $C_{Ns}^{n}$, where not all possible combinations are traversed but the chosen search pulses may still possibly traverse the Ns set.

B4. Obtaining the optimal codebook in the current search round which chooses from the basic codebook and the searched codebook according to a preset criterion.

This block may be performed with reference to block A4 in the foregoing embodiment.

In this embodiment, n takes a fixed value in a search round and different combinations of search pulses are chosen in turn. This improves the method for choosing search pulses and therefore the search process is more efficient. Further, if all possible combinations of search pulses are traversed, the global sense of a search result can be further enhanced so as to improve the quality of the search result.

Figure 4:
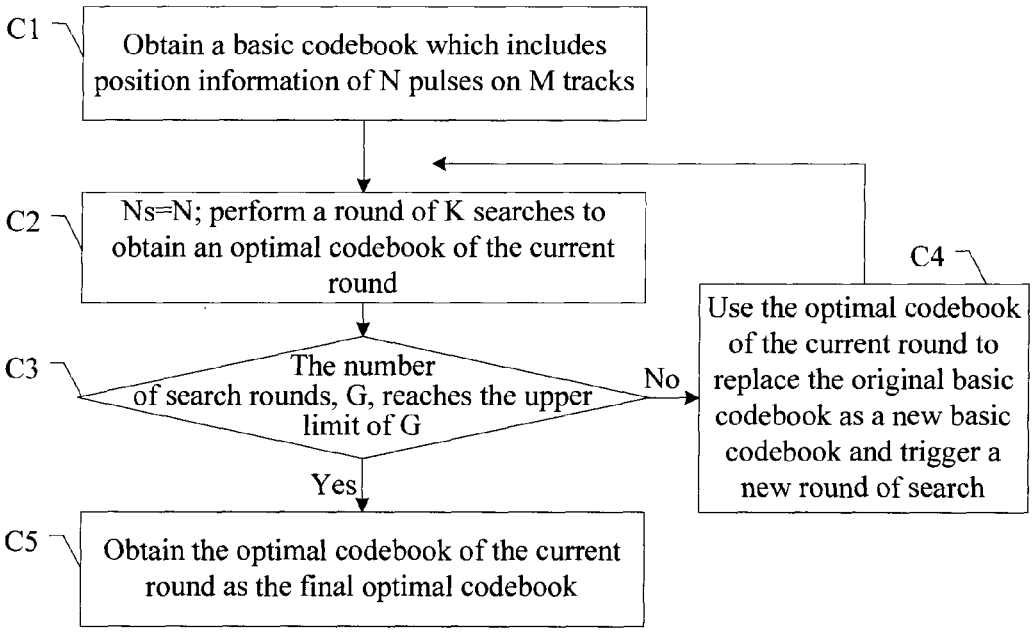
FIG. 4 is a flowchart of a method for searching fixed codebook according to an embodiment of the disclosure.

In embodiment 3 of the disclosure, a method for searching fixed codebook is provided with cyclic multi-round execution on the basis of the embodiment 1 and embodiment 2. As shown in FIG. 4, the procedure includes the following blocks:

C1. Obtaining a basic codebook, which includes position information of N pulses on M tracks, where N and M are positive integers.

This block may be performed with reference to block A1 in the foregoing embodiment.

C2. Suppose, for example, Ns=N, performing a round of K searches to obtain an optimal codebook of the current round.

This block may be performed with reference to blocks A2 to A4 in the embodiment 1 or blocks B2 to B4 in the embodiment 2. Because Ns=N, the search pulses may be chosen from all pulses in the basic codebook. For the method in the embodiment 2, in different rounds, the value of n may be identical or different.

C3. Determining whether the number of search rounds, G, reaches its upper limit; if so, the process proceeds to block C5; otherwise, the process proceeds to block C4.

C4. The optimal codebook replaces the previous basic codebook as a new basic codebook and the procedure goes back to block C2 to search for the optimal codebook of a new round.

C5. Obtaining the optimal codebook of the current round as the final optimal codebook.

In this embodiment of the disclosure, a multi-round approach is adopted to obtain the final optimal codebook, which further improves the quality of a search result. Or, the searching method provided in the embodiment 1 or embodiment 2 of the disclosure may be used only in one search round while in other rounds before or after this round, other searching methods may be adopted.

Figure 5:
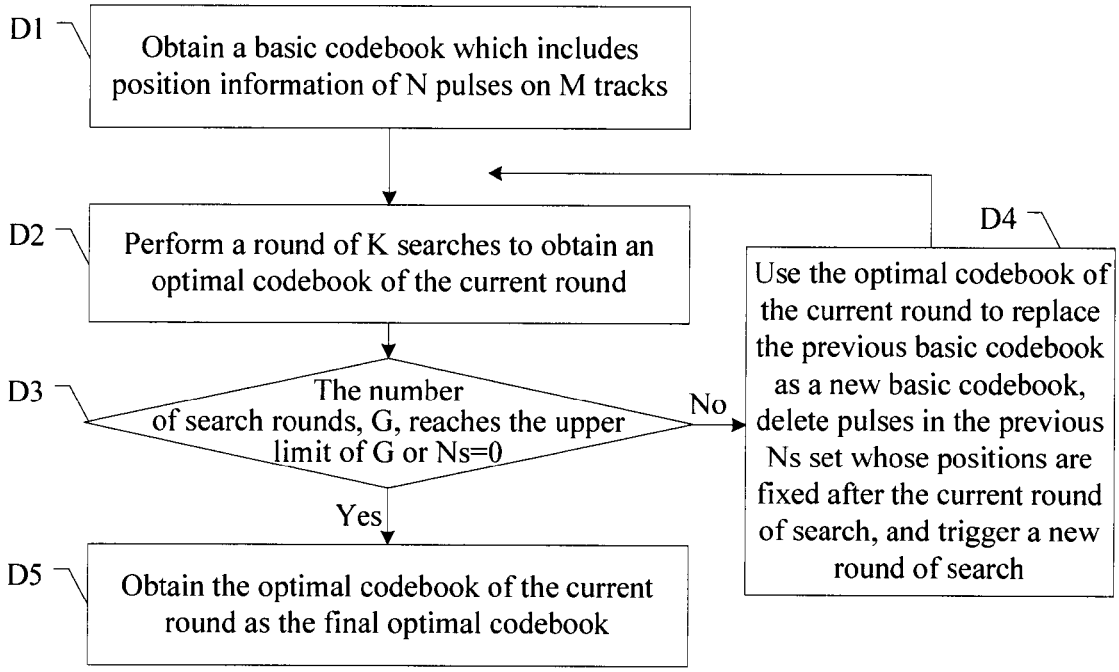
FIG. 5 is a flowchart of a method for searching fixed codebook according to an embodiment of the disclosure.

In embodiment 4 of the disclosure, a fixed codebook searching method is provided with another form of cyclic multi-round execution on the basis of the embodiment 1 and the embodiment 2. As shown in FIG. 5, the procedure includes the following blocks:

D1. Obtaining a basic codebook, which includes position information of N pulses on M tracks, where N and M are positive integers. This block may be performed with reference to block A1 in the embodiment 1.

D2. Performing a round of K searches to obtain an optimal codebook of the current round.

This block may be performed with reference to blocks A2 to A4 in the embodiment 1 or blocks B2 to B4 in the embodiment 2. In the first round of search, Ns may be set to be equal to N.

D3. Determining whether the number of search rounds, G, reaches its upper limit, or determining whether the Ns set for the next round is null; if so, the process proceeds to block D5; otherwise, the process proceeds to block D4.

In this embodiment, the Ns set of each round may be determined according to the search result of the previous round as in block D4. If the Ns set is null, the search is considered complete; or the search is considered complete according to the upper limit of G when the Ns set is not null.

D4. The optimal codebook replaces the previous basic codebook as a new basic codebook. The pulses in the previous Ns set and with fixed positions in the search process where the optimal codebook is obtained are used as new Ns pulses and the process returns back to block D2 to search for the optimal codebook of a new round.

Suppose, for example, the Ns set in the first round includes N=4 pulses, P0, P1, P2 and P3, respectively located on M=4 tracks, T0, T1, T2 and T3, with one pulse located on each track. Set n=n0=2 in the first round and perform K=6 searches to traverse all combinations of search pulses as in the embodiment 2. The combinations are: P0, P1; P0, P2; P0, P3; P1, P2; P1, P3; P2, P3. Suppose, for example, the optimal codebook is obtained when the P0 and P3 combination is chosen. Then it is known that the pulses fixed in the first round and belonging to the Ns set of the first round are P1 and P2. Therefore, the Ns set of the second round includes P1 and P2. If in the second round, n=n0=2, K=1 search is performed. The optimal codebook in the second round may be obtained when the P1 and P2 combination is chosen. In this round, the fixed pulses are P0 and P3 but the two pulses are not included in the Ns set of the second round. Therefore it is determined that the Ns set in the third round is null and the search is considered complete.

D5. Obtaining the optimal codebook of the current round as the final optimal codebook.

In this embodiment, the final optimal codebook is obtained via a multi-round search approach, which can further improve the quality of a search result. Furthermore, because the range of the Ns set for a next search round is reduced according to the search result of a previous round, the efforts of computation are effectively reduced.

Figure 6:
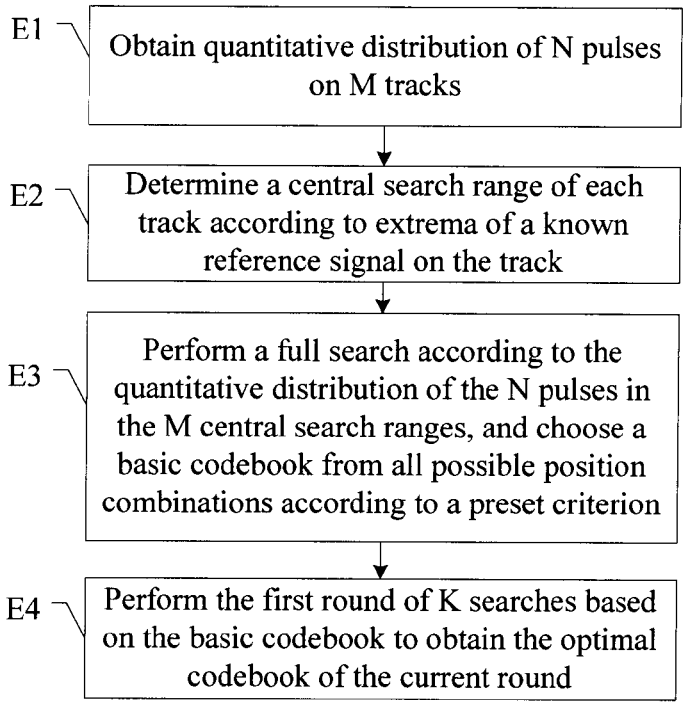
FIG. 6 is a flowchart of a method for searching fixed codebook according to an embodiment of the disclosure.

In an embodiment 5 of the disclosure, a fixed codebook searching method is provided with a specific initial basic codebook obtaining method on the basis of the foregoing embodiments. As shown in FIG. 6, the procedure includes the following blocks:

E1. Obtaining the quantitative distribution of N pulses on M tracks.

Specifically, this block is to determine the total number (N) of search pulses for the search and the number of pulses distributed on each track.

E2. According to a number of extreme values of known reference signals on each track, determining the central search range on each track, where the central search range includes at least one position on the track.

The reference signal may be the maximum likelihood function of a pulse position, b(i). The values of b(i) in all pulse positions are calculated and the positions on a track with the largest b(i) values are chosen as the central search range of the track. The number of positions included in the central search range of each track may be identical or different.

Suppose, for example, there are M=4 tracks, T0, T1, T2, and T3 and the position distribution of each track is shown in Table 1. The pulse positions on each track are rearranged in ascending order of the absolute value of b(i). Suppose, for example, the rearranged track position map is as follows:

```
{ T0, T1, T2, T3} =
{
    {0, 36, 32, 4, 40, 28, 16, 8, 20, 52, 44, 48, 12, 56, 24, 60},
    {1, 33, 37, 5, 29, 41, 17, 9, 49, 21, 53, 25, 13, 45, 57, 61},
    {34, 2, 38, 30, 6, 18, 42, 50, 26, 14, 10, 22, 54, 46, 58, 62},
    {35, 3, 31, 39, 7, 19, 27, 51, 15, 43, 55, 47, 23, 11, 59, 63}
}
```

Then, if four positions with the largest absolute b(i) values on each track are chosen as the central search range of the track, the central search range of the basic codebook is:

```
{
  {0, 36, 32, 4},
  {1, 33, 37, 5},
  {34, 2, 38, 30},
  {35, 3, 31, 39}
  }
```

E3. Performing a full search according to the quantitative distribution of the N pulses in the M central search ranges, and choosing a basic codebook from all possible position combinations according to a preset criterion.

Because the central search range is usually small, it is possible to perform a full search in the range to obtain a preferred basic codebook.

For example, suppose the basic codebook includes altogether N=4 pulses, P0, P1, P2, and P3, respectively located on M=4 tracks, T0, T1, T2, and T3, with one pulse on each track; then for the search ranges given in block E2, it is only necessary to perform 4×4×4×4=256 searches to obtain the basic codebook.

E4. Performing the first round of K searches based on the basic codebook to obtain the optimal codebook of the current round.

This block may be performed with reference to blocks A2 to A4 in the embodiment 1 or blocks B2 to B4 in the embodiment 2.

In this embodiment, the initial basic codebook is obtained via a central search approach, so as to assure quality of the obtained basic codebook and further improve quality of the search result.

It is understandable that the software, including computer readable instructions, for implementing the fixed basic codebook searching method under the present disclosure may be stored, or otherwise tangibly embodied, in a computer readable medium. The software execution includes the following blocks: obtaining a basic codebook, which includes position information of N pulses on M tracks, where N and M are positive integers; choosing n pulses as search pulses, where the n pulses are part of the N pulses and n is a positive integer smaller than N; replacing the positions of the n pulses with other positions on the track respectively to obtain a searched codebook; performing the search process for K times as a round, where K is a positive integer larger than or equal to 2 and at least one search process chooses two or more search pulses, and the chosen search pulses vary with each search; and obtaining an optimal codebook for the current round which chooses from the basic codebook and the searched codebook according to a preset criterion. The computer readable medium may be, for example, a Read-Only Memory/Random Access Memory (ROM/RAM), a magnetic disk, a compact disk, etc.

For better understanding of the foregoing embodiments, a computation example is provided hereunder.

Suppose, for example, there are altogether N=4 pulses, P0, P1, P2, and P3, respectively located on M=4 tracks, T0, T1, T2, and T3, with one pulse on each track. The distribution of the pulses on the tracks is shown in Table 1. Then the search process includes:

1. Obtaining the initial basic codebook as a result of a full search from the central search range of each track including 4 positions according to the initial basic codebook obtaining method provided in the embodiment 5. Suppose, for example, the obtained initial basic codebook is {32, 33, 2, 35}. The number of required searches is 4×4×4×4=256.

2. Starting the first round of search, setting n=n0=2 and performing K=6 searches to traverse all combinations of search pulses as in the embodiment 2. Each search covers 4 positions on one track and 12 positions on another track (the counted positions already include the pulse positions in the basic codebook; the method for choosing positions for search may be similar to the method for determining the central search range of the basic codebook). Suppose, for example, the optimal codebook obtained in the first round is {32, 33, 6, 35} when the fixed pulses are P0 and P1.

The number of required searches is 6×(4×12)=288.

3. Starting a second round of search. Setting n=n0=2, fixing the positions of P2 and P3, {6, 35}, and performing K=1 search for the combination of P0 and P1. This search covers 4 positions on T0 and T1 respectively. Suppose, for example, the optimal codebook obtained in the second round of search is {32, 33, 6, 35}. The number of required searches is 4×4=16.

4. Determining that the Ns set of search pulses is null, which means positions of all pulses in the basic codebook are searched. The final optimal codebook is therefore {32, 33, 6, 35}. The total number of searches is 256+288+16=560.

Apply the method in the foregoing example to a test sequence made up of 24 male speech sequences and 24 female speech sequences; encode/decode the speeches, and comparing the objective speech quality of the encoding/decoding result with the encoding/decoding result of the prior Depth-First Tree Search Procedure. The speech quality obtained via the two methods is equivalent. In the foregoing method, the number of searches is 560, far smaller than the number of searches, 768, in the Depth-First Tree Search Procedure.

An apparatus for searching fixed codebook under the present disclosure is detailed below.

Figure 7:
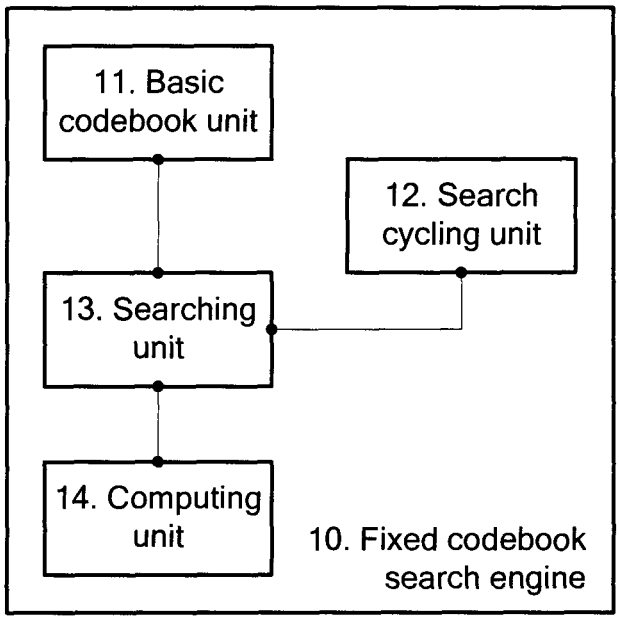
FIG. 7 shows a logical structure of a apparatus for searching fixed codebook according to an embodiment of the disclosure.

According to an embodiment 6 of the disclosure, an apparatus for searching fixed codebook 10 shown in FIG. 7 includes a basic codebook unit 11, a search cycling unit 12, a searching unit 13, and a computing unit 14.

The basic codebook unit 11 is adapted to provide a basic codebook which includes position information of N pulses on M tracks, where N and M are positive integers.

The search cycling unit 12 is adapted to choose search pulses and determine to perform K searches on the search pulses in a cyclic round as follows: choose n pulses as search pulses, where the n pulses are part of the N pulses and n is a positive integer smaller than N, and where K is a positive integer larger than or equal to 2 and at least one of the K searches chooses two or more search pulses, and the chosen search pulses vary with each search.

Preferably, the search cycling unit 12 chooses n pluses as search pulses in the procedure below:

The search cycling unit 12 chooses n pluses from Ns pulses as the search pulses, where the Ns pulses are all or part of the N pulses, Ns is a positive integer smaller than or equal to N, and n is a positive integer smaller than Ns, and fixes positions of pulses in the basic codebook other than the n search pulses.

The searching unit 13 is adapted to fix positions of pulses in the basic codebook provided by the basic codebook unit 11 other than the n search pulses and replace positions of the n search pulses respectively with other positions on the track according to each choice of the search cycling unit 12 to obtain a searched codebook.

The computing unit 14 is adapted to obtain an optimal codebook of the current round which chooses from the basic codebook and the searched codebook provided by the searching unit 13 after K cyclic searches according to a preset criterion.

An apparatus for searching fixed codebook provided in this embodiment may be adapted to execute the method for searching fixed codebook provided in the embodiment 1.

Figure 8:
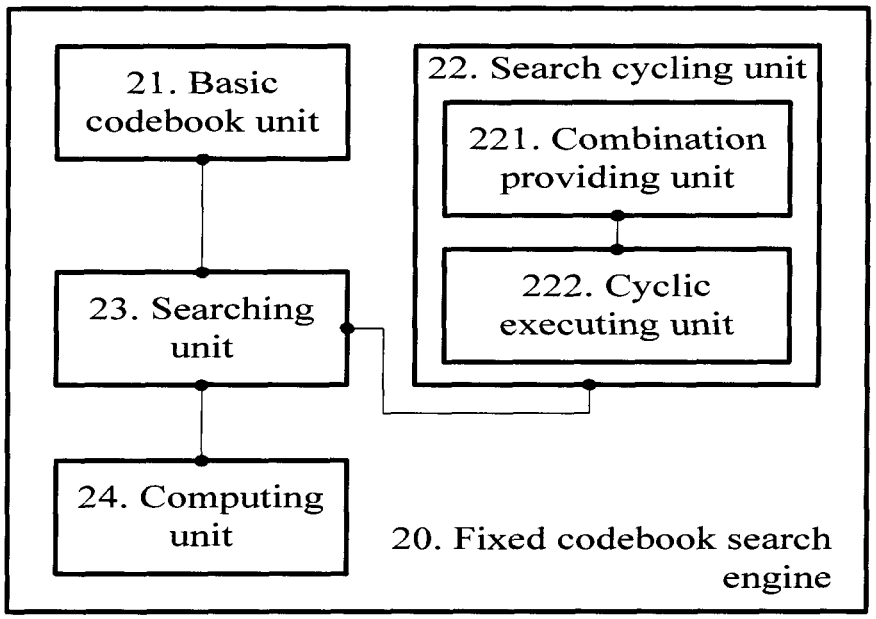
FIG. 8 shows a logical structure of a apparatus for searching fixed codebook according to an embodiment of the disclosure.

According to an embodiment 7 of the disclosure, an apparatus for searching fixed codebook 20 shown in FIG. 8 includes a basic codebook unit 21, a search cycling unit 22, a searching unit 23, and a computing unit 24.

The basic codebook unit 21 is adapted to provide a basic codebook which includes position information of N pulses on M tracks, where N and M are positive integers.

The search cycling unit 22 includes: a combination providing unit 221, adapted to provide all $C_{Ns}^{n}$ possible combinations for choosing n pulses from Ns pulses as search pulses, where n is larger than or equal to 2, the Ns pulses are all or part of the N pulses, and Ns is a positive integer smaller than or equal to N; and a cyclic executing unit 222, adapted to choose one of all the $C_{Ns}^{n}$ possible combinations provided by the combination providing unit 221 for K cyclic searches without repetition in sequence or at random, where $2 \leqq K \leqq C_{Ns}^{n}$.

The searching unit 23 is adapted to fix positions of pulses in the basic codebook provided by the basic codebook unit 21 other than the n search pulses and replace positions of the n search pulses respectively with other positions on the track according to each choice of the search cycling unit 22 to obtain a searched codebook.

The computing unit 24 is adapted to choose an optimal codebook of the current round from the basic codebook and the searched codebook provided by the searching unit 23 after K cyclic searches according to a preset criterion.

An apparatus for searching fixed codebook provided in this embodiment may be adapted to execute the fixed codebook searching method provided in the embodiment 2.

Figure 9:
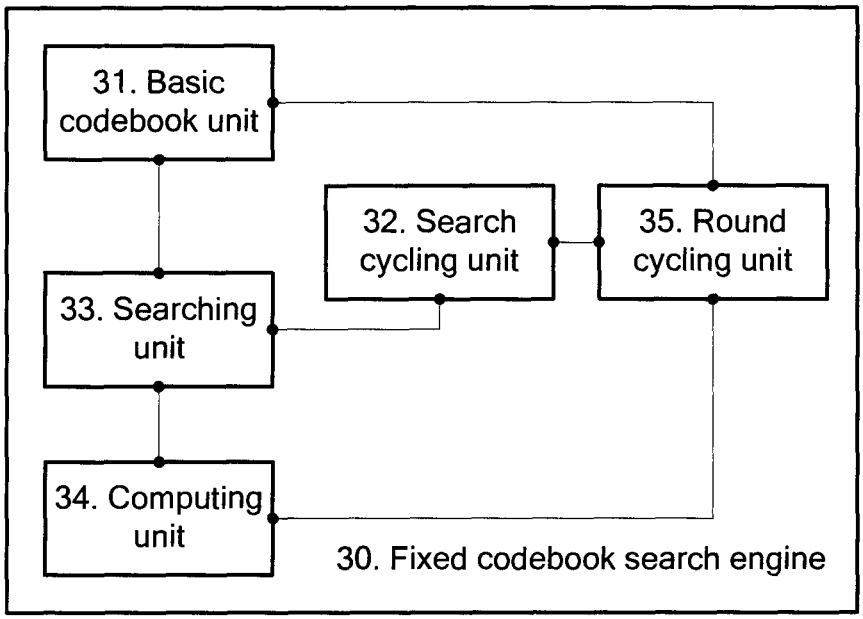
FIG. 9 shows a logical structure of a apparatus for searching fixed codebook according to an embodiment of the disclosure.

According to an embodiment 8 of the disclosure, a fixed codebook searching engine 30 shown in FIG. 9 includes a basic codebook unit 31, a search cycling unit 32, a searching unit 33, a computing unit 34, and a round cycling unit 35.

The basic codebook unit 31 is adapted to provide a basic codebook which includes position information of N pulses on M tracks, where N and M are positive integers.

The search cycling unit 32 is adapted to choose search pulses and determine to perform K searches on the search pulses in a cyclic round as follows: choose n pulses as search pulses, where the n pulses are part of the N pulses and n is a positive integer smaller than N, and where K is a positive integer larger than or equal to 2, at least one of the K searches chooses two or more search pulses, and the chosen search pulses vary with each search.

Preferably, the search cycling unit 32 chooses n pluses as search pulses as follows: the search cycling unit 32 chooses n pluses from Ns pulses as the search pulses, where the Ns pulses are all or part of the N pulses, Ns is a positive integer smaller than or equal to N, and n is a positive integer smaller than Ns, and fixes positions of pulses in the basic codebook other than the n search pulses.

The searching unit 33 is adapted to fix positions of pulses in the basic codebook provided by the basic codebook unit 31 other than the n search pulses and replace positions of the n search pulses respectively with other positions on the track according to each choice of the search cycling unit 32 to obtain a searched codebook.

The computing unit 34 is adapted to obtain an optimal codebook of the current round which chooses from the basic codebook and the searched codebook provided by the searching unit 33 after K cyclic searches according to a preset criterion.

The round cycling unit 35 is adapted to replace the original basic codebook provided by the basic codebook unit 31 with the optimal codebook of the current round obtained by the computing unit 34 and trigger the search cycling unit 32 to execute a next round of search.

According to specific settings, when the round cycling unit 35 triggers the search cycling unit 32 to execute the next round of search, the Ns set in the search cycling unit 32 may be reset by deleting the pulses whose positions are fixed after the previous round of search. The round cycling unit 35 may determine whether to continue triggering the search cycling unit 32 to start a next round of search according to the value of Ns or according to the upper limit of rounds.

An apparatus for searching fixed codebook provided in this embodiment may be adapted to execute the fixed codebook searching method provided in the embodiment 3 or embodiment 4.

Figure 10:
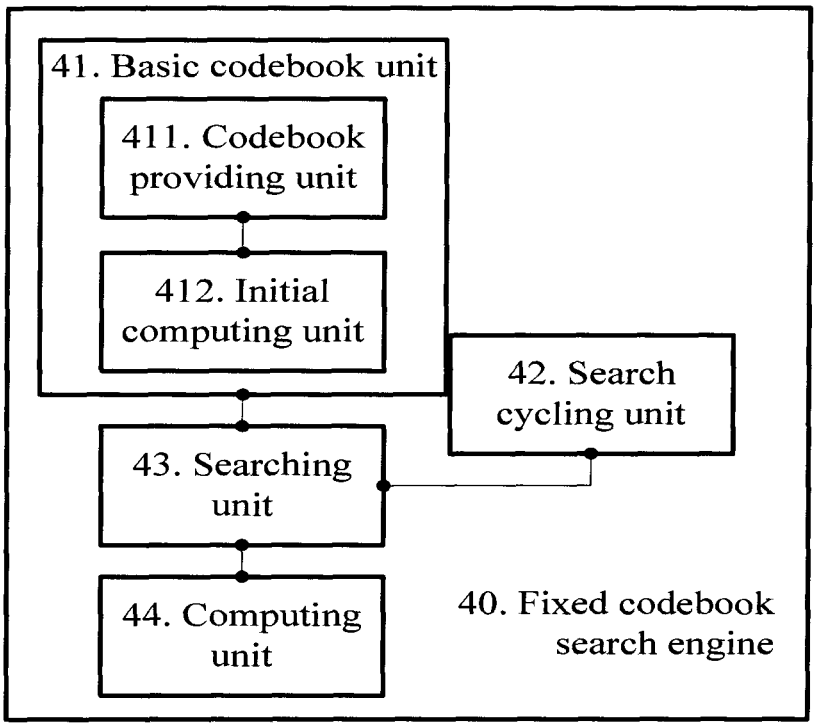
FIG. 10 shows a logical structure of a apparatus for searching fixed codebook according to an embodiment of the disclosure.

According to an embodiment 9 of the disclosure, a fixed codebook searching engine 40 shown in FIG. 10 includes a basic codebook unit 41, a search cycling unit 42, a searching unit 43, and a computing unit 44.

The basic codebook unit 41 includes: a codebook providing unit 411, adapted to provide a basic codebook, including obtaining quantitative distribution of N pulses on M tracks and setting positions of pulses on each track at random; and an initial computing unit 412, adapted to compute and initialize the basic codebook in the codebook providing unit 411.

The search cycling unit 42 is adapted to perform the following operation for K cyclic times in a round: choose n pulses from Ns pulses as search pulses, where the Ns pulses are all or part of the N pulses, Ns is a positive integer smaller than or equal to N, and n is a positive integer smaller than Ns, and where K is a positive integer larger than or equal to 2, at least one of the K searches chooses two or more search pulses and the chosen search pulses vary with each search.

The searching unit 43 is adapted to fix positions of pulses in the basic codebook provided by the basic codebook unit 41 other than the n search pulses and replace positions of the n search pulses respectively with other positions on the track according to each choice of the search cycling unit 42 to obtain a searched codebook. The computing unit 44 is adapted to choose an optimal codebook of the current round from the basic codebook and the searched codebook provided by the searching unit 43 after K cyclic searches according to a preset criterion. An apparatus for searching fixed codebook provided in this embodiment may be adapted to execute the fixed codebook searching method provided in the embodiment 5.

In this embodiment of the disclosure, the optimal codebook is obtained by replacing pulse combinations, where at least one search covers multiple pulses. Because the optimal codebook is chosen from replacements of different combinations, the method can reduce the number of searches to the greatest possible extent while performing a global search. In addition, because at least one search covers multiple pulses, the impact of correlations between pulses on the search result can be considered so as to further assure the quality of the search result. If n takes a fixed value in a search round and different combinations of search pulses are chosen in turn, the method for choosing search pulses is optimized so that the search process is more efficient. Further, if all possible combinations of search pulses are traversed, the global sense of a search result can be further enhanced so as to improve quality of the search result. If, further, a multi-round approach is adopted to obtain the final optimal codebook, the quality of the search result is further improved. Or, the searching method provided in the embodiment 1 or embodiment 2 of the disclosure may be used only in one search round while in other rounds before or after this round, other searching methods may be adopted. If, further, a multi-round search approach is adopted to obtain the final optimal codebook and reduce the Ns set range of the next search round according to the search result of the previous round, the efforts of computation can be reduced effectively. If, further, a central search approach is adopted to obtain the initial basic codebook, the quality of the obtained basic codebook is assured and the quality of the search result is further improved. Although the disclosure has been described through exemplary embodiments, the disclosure is not limited to such embodiments. It is apparent that those skilled in the art can make various modifications and variations to the disclosure without departing from the spirit and scope of the disclosure. The disclosure is intended to cover the modifications and variations provided that they fall in the scope of protection defined by the claims or their equivalents.

What is claimed is:

1. A method for searching a fixed codebook, comprising:

obtaining a basic codebook, the basic codebook comprising initial position information of N pulses on M tracks, wherein each of the M tracks comprises multiple positions, and wherein N and M are positive integers;

in a search round, repeating the following search process for K times:

(1) choosing, from the basic codebook, n pulses from the N pulses as search pulses, wherein n is a positive integer smaller than N; and (2) replacing each of initial positions of the n search pulses with a different position on the same track, so as to obtain a searched codebook;

wherein K is a positive integer larger than or equal to 2, at least two search pulses are chosen in at least one of the K search processes, the at least two search pulses are distributed on different tracks, and the search pulses vary with each search process;

choosing an optimal codebook from the basic codebook and the K searched codebooks according to a preset criterion; and replacing the basic codebook with the optimal codebook as a basic codebook for a next search round.

2. The method of claim 1, wherein choosing n pulses as search pulses comprises:

choosing n pulses from Ns pulses as the search pulses, wherein the Ns pulses are all or a part of the N pulses, Ns is a positive integer smaller than or equal to N, and n is a positive integer smaller than Ns; and fixing positions of pulses in the basic codebook other than the search pulses.

3. The method of claim 2, wherein choosing n pulses from Ns pulses as the search pulses comprises:

choosing a combination of n pulses at random from the Ns pulses as the search pulses, and wherein the search process is repeated until an upper limit of K is reached; or when the upper limit of K is not reached, the search process is repeated until the search pulses have traversed the Ns pulses.

4. The method of claim 3, wherein choosing n pulses at random from Ns pulses as the search pulses comprises:

determining the value of n, wherein n is larger than or equal to 2, and choosing one of all $C_{Ns}^{n}$ possible combinations without repetition in sequence or at random in each search process, and wherein $K \leqq C_{Ns}^{n}$.

5. The method of claim 1, wherein replacing each of initial positions of the n search pulses with a different position on the same track comprises:

replacing each of the initial positions of the n search pulses with a different position in a preset range on the same track.

6. The method of claim 1, further comprising:

repeating the search round until the number of search rounds, G, reaches a set upper limit.

7. The method of claim 2, further comprising:

using pulses in previous Ns pulses with fixed positions in the search process wherein the optimal codebook is obtained as new Ns pulses, and continuing to search for a next optimal codebook in a next search round; and repeating the search round until the number of search rounds, G, reaches a set upper limit.

8. The method of claim 1, wherein obtaining a basic codebook comprises:

obtaining a quantitative distribution of the N pulses on the M tracks; and setting positions of pulses on each track at random or determining positions of pulses on each track according to a number of extreme values of a known reference signal on each track.

9. The method of claim 1, wherein obtaining a basic codebook comprises:

obtaining a quantitative distribution of the N pulses on the M tracks;

determining a central search range on each track, wherein the central search range comprises at least one position on each track according to a number of extreme values of a known reference signal on each track; and performing a full search according to the quantitative distribution of the N pulses in M central search ranges, and choosing a basic codebook from all possible position combinations according to a preset criterion.

10. The method of claim 1, wherein choosing an optimal codebook from the basic codebook and the searched codebooks according to a preset criterion is performed simultaneously with obtaining a searched codebook, and, for each search process, choosing an optimal codebook comprises:

comparing the searched codebook with the basic codebook according to a preset criterion to select as the next basic codebook; and choosing the next basic codebook as an optimal codebook of the search round.

11. An apparatus, comprising:

a basic codebook unit, configured to provide a basic codebook comprising initial position information of N pulses on M tracks, wherein each of the M tracks comprises multiple positions, ans wherein N and M are positive integers;

a search cycling unit, configured to, in a search round, repeat the following search process for K times:

(1) choosing, from the basic codebook, n pulses from the N pulses as search pulses, wherein n is a positive integer smaller than N; and (2)replacing each of initial positions of the n search pulses with a different positions of on the same track, so as to obtain a searched codebook;

wherein K is a positive integer larger than or equal to 2, at least two search pulses are chosen in at least one of the K search processes, the at least two search pulses are distributed on different tracks, and the search pulses vary with each search process;

a computing unit, configured to choose an optimal codebook from the basic codebook and the K searched codebooks according to a preset criterion; and replace the basic codebook with the optimal codebook as a basic codebook for a next search round.

12. The apparatus of claim 11, wherein the search cycling unit configured to choose n pulses from N pulses as search pulses is further configured to:

choose n pulses from Ns pulses as the search pulses, wherein the Ns pulses are all or a part of the N pulses, Ns is a positive integer smaller than or equal to N, and n is a positive integer smaller than Ns; and fix positions of pulses in the basic codebook other than the n search pulses.

13. The apparatus of claim 12, wherein the search cycling unit configured to choose n pulses from Ns pulses as search pulses is further configured to:

provide all $C_{Ns}^{n}$ possible combinations for choosing n pulses from Ns pulses as search pulses, wherein n is larger than or equal to 2; and choose one of all the $C_{Ns}^{n}$ possible combinations without repetition in sequence or at random in each search process, and wherein $K \leqq C_{Ns}^{n}$.

14. The apparatus of claim 11, wherein the basic codebook unit configured to provide a basic codebook is further configured to:

obtain a quantitative distribution of the N pulses on the M tracks, and set positions of pulses on each track at random or determine positions of pulses on each track according to a number of extreme values of a known reference signal on each track.

15. A non-transitory computer readable storage medium storing computer program codes thereon for execution by a computer unit, the program code comprise instructions for:

obtaining a basic codebook, the basic codebook comprising initial position information of N pulses on M tracks, wherein each of the M tracks comprises multiple positions, and wherein N and M are positive integers;

in a search round, repeating the following search process for K times:

(1) choosing, from the basic codebook, n pulses from the N pulses as search pulses, wherein n is a positive integer smaller than N; and (2) replacing each of initial positions of the n search pulses with a different position information on the same track, so as to obtain a searched codebook;

wherein K is a positive integer larger than or equal to 2, at least two search pulses are chosen in one of the K search processes, the at least two search pulses are distributed on different tracks, and the search pulses vary with each search process;

choosing an optimal codebook from the basic codebook and the searched codebooks according to a preset criterion; and replacing the basic codebook with the optimal codebook as a basic codebook for a next search round.

16. A method for searching a fixed codebook, comprising:

obtaining a basic codebook as a preferred codebook, wherein the preferred codebook comprises initial positions of N pulses on M tracks, wherein each of the M tracks comprises multiple positions, and wherein N and M are positive integers;

choosing n search pulses, wherein the n search pulses are part of the N pulses and n is a positive integer smaller than N; and replacing each of the initial positions of the n search pulses with a different position on the same track, so as to obtain a searched codebook;

selecting one of the searched codebook and the basic codebook as a new preferred codebook according to a preset criterion;

executing the obtaining of the searched codebook and the selecting of the preferred codebook as a search process for K times to obtain a new preferred codebook as an optimal codebook, wherein the choosing of n pulses in each search process is from the same basic codebook, and K is a positive integer larger than or equal to 2, at least two search pulses are chosen in at least one of the K search processes, and the at least two search pulses are distributed on different tracks; and replacing the basic codebook by using the optimal codebook as a next basic codebook, wherein the next basic codebook is the basis for each search process to obtain a next optimal codebook in a next search round.

17. The method of claim 16, wherein choosing n search pulses comprises:

choosing n pulses from Ns pulses, wherein the Ns pulses are all or a part of the N pulses, Ns is a positive integer smaller than or equal to N, and n is a positive integer smaller than Ns; and fixing positions of pulses in the basic codebook other than the n search pulses.

18. The method of claim 17, wherein choosing n pulses from Ns pulses comprises:

choosing a combination of n pulses at random from the Ns pulses as the search pulse, and wherein the search process is repeated until an upper limit of K is reached; or when the upper limit of K is not reached, the search process is repeated until the chosen search pulses have traversed the Ns pulses.

19. The method of claim 18, wherein choosing n pulses at random from Ns pulses as the search pulses comprises:

determining the value of n, wherein n is larger than or equal to 2, and choosing one of all $C_{Ns}^{n}$ possible combinations without repetition in sequence or at random in each search process; and wherein $K \leqq C_{Ns}^{n}$.

* * * * *